US006336572B1

(12) United States Patent
Fujikawa et al.

(10) Patent No.: US 6,336,572 B1
(45) Date of Patent: Jan. 8, 2002

(54) LIQUID FILLING APPARATUS AND METHOD OF USING SAME

(75) Inventors: Yasuji Fujikawa; Kazuo Abe; Masakatsu Kondo; Michio Ueda, all of Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/427,034

(22) Filed: Oct. 26, 1999

(30) Foreign Application Priority Data

Oct. 28, 1998 (JP) ..... 10-306510

(51) Int. Cl.[7] ..... B67D 5/40

(52) U.S. Cl. ..... 222/380; 222/504; 141/67; 141/103; 141/183

(58) Field of Search ..... 222/380, 372, 222/504, 495, 497; 141/103, 183, 67

(56) References Cited

U.S. PATENT DOCUMENTS 5,765,729 A * 6/1998 Miller et al. ..... 222/380
5,769,136 A * 6/1998 Kanematsu et al. ..... 222/504
5,950,691 A * 9/1999 Abe et al. ..... 141/103

FOREIGN PATENT DOCUMENTS

EP 0 775 635 A1 5/1997
GB 1039190 8/1966

* cited by examiner

*Primary Examiner*—Philippe Derakshani
(74) *Attorney, Agent, or Firm*—Armstrong, Westerman, Hattori, McLeland & Naughton, LLP

(57) ABSTRACT

A liquid filling apparatus comprises an apparatus body having a liquid channel connected at one end thereof to a liquid tank and at the other end thereof to a filling nozzle, a metering cylinder provided in the liquid channel between opposite ends thereof in communication with the ends for causing the liquid to be filled to flow into and out of the liquid channel by strokes of a piston housed in the cylinder, a check valve disposed upstream from the metering cylinder of the liquid channel, and valve opening-closing means for mechanically operating the check valve so as to open the valve during the inflow stroke of the piston and to close the valve during the outflow stroke of the piston.

5 Claims, 3 Drawing Sheets

LIQUID FILLING APPARATUS AND METHOD OF USING SAME

BACKGROUND OF THE INVENTION

The present invention relates to a liquid filling apparatus for filling a liquid into containers in a specified amount in each container.

Apparatus of the type mentioned are already known which comprises an apparatus body having a liquid channel connected at one end thereof to a liquid tank and at the other end thereof to a filling nozzle, a metering cylinder provided in the channel between opposite ends thereof in communication with the ends for causing the liquid to be filled to flow into and out of the liquid channel by strokes of a piston housed in the cylinder, and a check valve disposed upstream from the metering cylinder of the liquid channel. The check valve is forced open by a negative pressure produced within the metering cylinder by the inflow stroke of the piston.

The liquids to be filled include those which contain a gas as it is or as dissolved in the liquid and are liable to release bubbles. Such liquids are, for example, a liquid which needs to be filled hot, a liquid which has not been treated for deaeration before feeding to the filling apparatus, and a liquid which is liable to alter in properties due to a pressure change. When subjected to a negative pressure produced within the metering cylinder, such a liquid releases bubbles. If the bubbles produced remain and collect within the metering cylinder, the amount of liquid to be filled decreases with time.

The decrease in the amount of liquid to be filled can be prevented by discharging the bubbles from the metering cylinder every stroke of the piston. For this purpose, it is conventional practice to produce turbulence within the metering cylinder by ingeniously shaping the cylinder, cause the bubbles produced in the cylinder to flow out of the cylinder along with the liquid to be filled and fill the outflow into a container. However, if the bubbles are placed into the container along with the liquid, the liquid is liable to bubble up or scatter to result in a lower filling capacity.

SUMMARY OF THE INVENTION

An object of the present invention is to prevent formation of bubbles within the metering cylinder and to provide a liquid filling apparatus which is free of the problems due to the occurrence of bubbles and a method of using the apparatus.

The present invention provides a liquid filling apparatus comprising an apparatus body having a liquid channel connected at one end thereof to a liquid tank and at the other end thereof to a filling nozzle, a metering cylinder provided in the liquid channel between opposite ends thereof in communication with the ends for causing the liquid to be filled to flow into and out of the liquid channel by strokes of a piston housed in the cylinder, and a check valve disposed upstream from the metering cylinder of the liquid channel, the liquid filling apparatus being characterized in that the apparatus comprises valve opening-closing means for mechanically operating the check valve so as to open the valve during the inflow stroke of the piston and to close the valve during the outflow stroke of the piston.

The liquid filling apparatus of the invention has valve opening-closing means for mechanically operating the check valve so as to open the valve during the inflow stroke of the piston and to close the valve during the outflow stroke of the piston. Accordingly, no negative pressure is produced within the metering cylinder by the inflow stroke of the piston, with the result that the liquid to be filled is prevented from releasing bubbles. The absence of bubbles entails the following advantages. First, the amount of liquid to be filled is stabilized. Second, the liquid can be filled in a satisfactory state, permitting a high-speed filling operation. Third, even if the liquid is deaerated insufficiently when to be fed to the filling apparatus, the liquid can be filled satisfactorily to improve the freedom of the plant equipment. Fourth, with no limitations imposed on the capacity or shape of the metering cylinder, the filling apparatus can be designed with greater freedom.

Preferably, the liquid filling apparatus comprises means for setting the check valve at large and small two degrees of opening.

According to an embodiment of the invention, the liquid filling apparatus further comprises a valve seat facing downstream with respect to the direction of flow of the liquid and provided on a peripheral wall defining the liquid channel at a portion thereof upstream from the metering cylinder; the check valve comprising a valve disk movable toward and away from the valve seat on the downstream side thereof with respect to the flow direction, and a spring for biasing the valve disk toward the valve seat; the valve opening-closing means comprising a fluid pressure cylinder having a piston rod and so disposed as to move the valve disk away from the valve seat by an advancing stroke of the piston rod; the setting means comprising a movable engaging member engageable with and disengageable from the piston rod, and an actuator for moving the engaging member so that the disengagement of the member from the piston rod and the engagement of the member with the piston rod correspond respectively to the large and small degrees of opening of the check valve. The check valve can then be set easily at the large degree of opening or alternatively at the small degree.

The engaging member may be so disposed as to be movable straight across the path of movement of the piston rod, the actuator being a fluid pressure cylinder having a piston rod connected to the engaging member.

The liquid filling apparatus may further be so adapted that the interior of the liquid channel is cleaned or deaerated with the check valve set at the large degree of opening, and that the check valve is set at the small degree of opening for the filling operation. The liquid channel can then be cleaned or deaerated rapidly, smoothly and efficiently, while the outflow and inflow strokes of the piston can be readily timed with the opening and closing of the check valve.

DESCRIPTION OF THE PREFERRED EMBODIMENT

An embodiment of the present invention will be described below with reference to the drawings.

Figure 1:
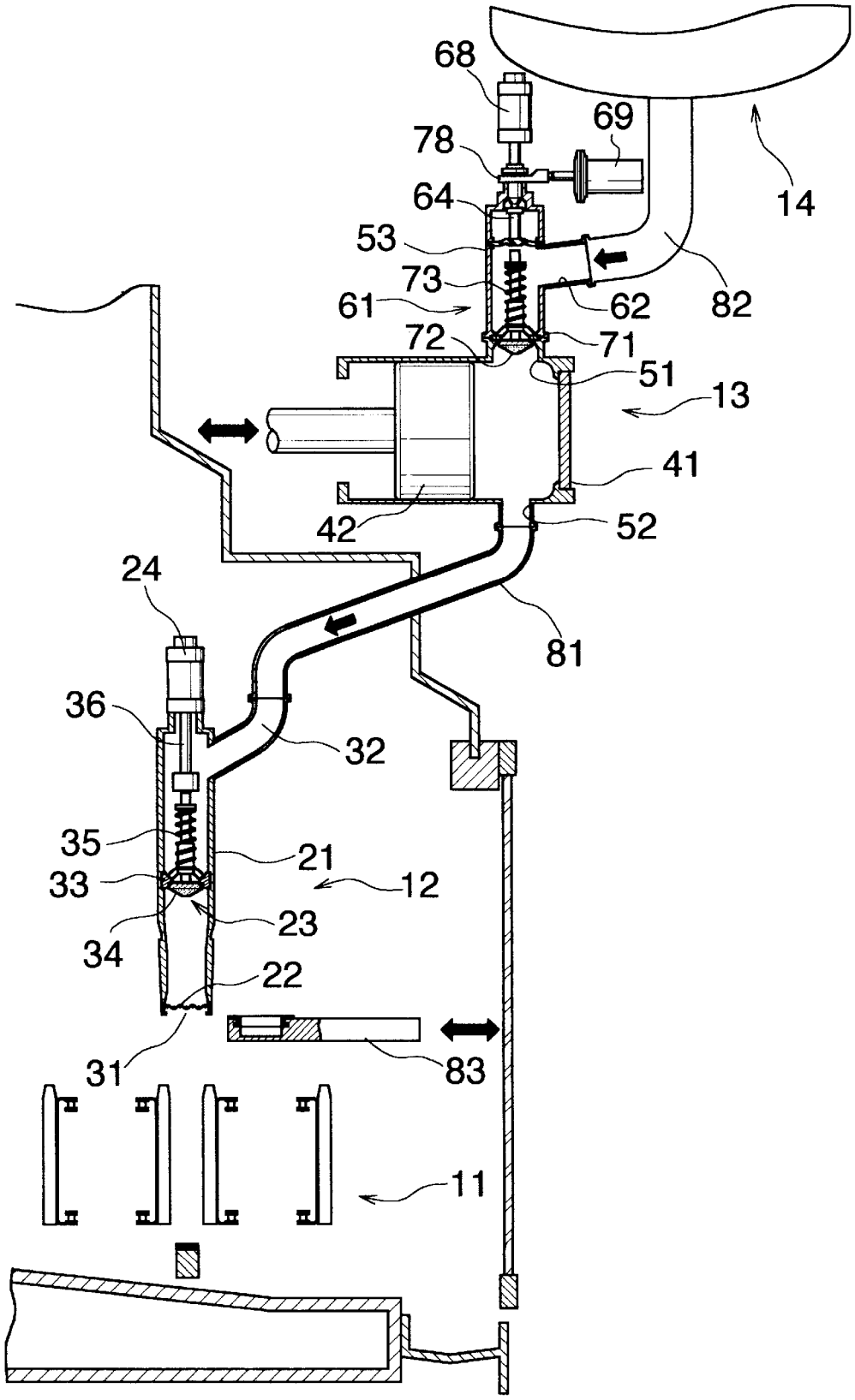
FIG. 1 is a view in vertical section of a filling apparatus of the invention.

FIG. 1 shows a filling apparatus which comprises a filling nozzle 12 disposed above the path of transport of a container conveyor 11, a metering cylinder 13 for feeding the liquid to be filled to the nozzle 12 in a specified amount at a time, and a tank 14 for containing the liquid to be fed to the metering cylinder 13.

The filling nozzle 12 comprises a vertical tubular nozzle body 21, a net 22 provided at the lower end of the nozzle body 21 for causing the surface tension of the liquid within the nozzle body 21 to prevent the liquid from flowing down under gravity, a lower check valve 23 disposed within the nozzle body 21 at the approximate midportion of its height for permitting the passage of the liquid free therethrough downward, and a first fluid pressure cylinder 24 attached as directed downward to the upper end of the nozzle body 21 for opening the lower check valve 23 by pushing down.

The nozzle body 21 has a downward outlet 31 at its lower end and a lateral inlet 32 positioned above the check valve 23 and close to the upper end of the body.

The lower check valve 23 comprises a seat ring 33 provided on the inner surface of the nozzle body 21 at the midportion of its height, a poppet valve 34 positioned under and in intimate contact with the seat ring 33, and a spring 35 for biasing the poppet valve 34 upward.

The fluid pressure cylinder 24 has a rod 36 extending into the nozzle body 21 and in bearing contact with the upper end of the stem of the poppet valve 34.

The metering cylinder 13 comprises a horizontal cylinder body 41 having a closed end and a piston 42 housed in the cylinder body 41.

The cylinder body 41 has close to its closed end an inlet 51 facing upward and an outlet 52 facing downward. The edge portion of the inlet 51 is provided with a connecting tubular portion 53 having a closed upper end and communicating with the inlet.

Figure 2:
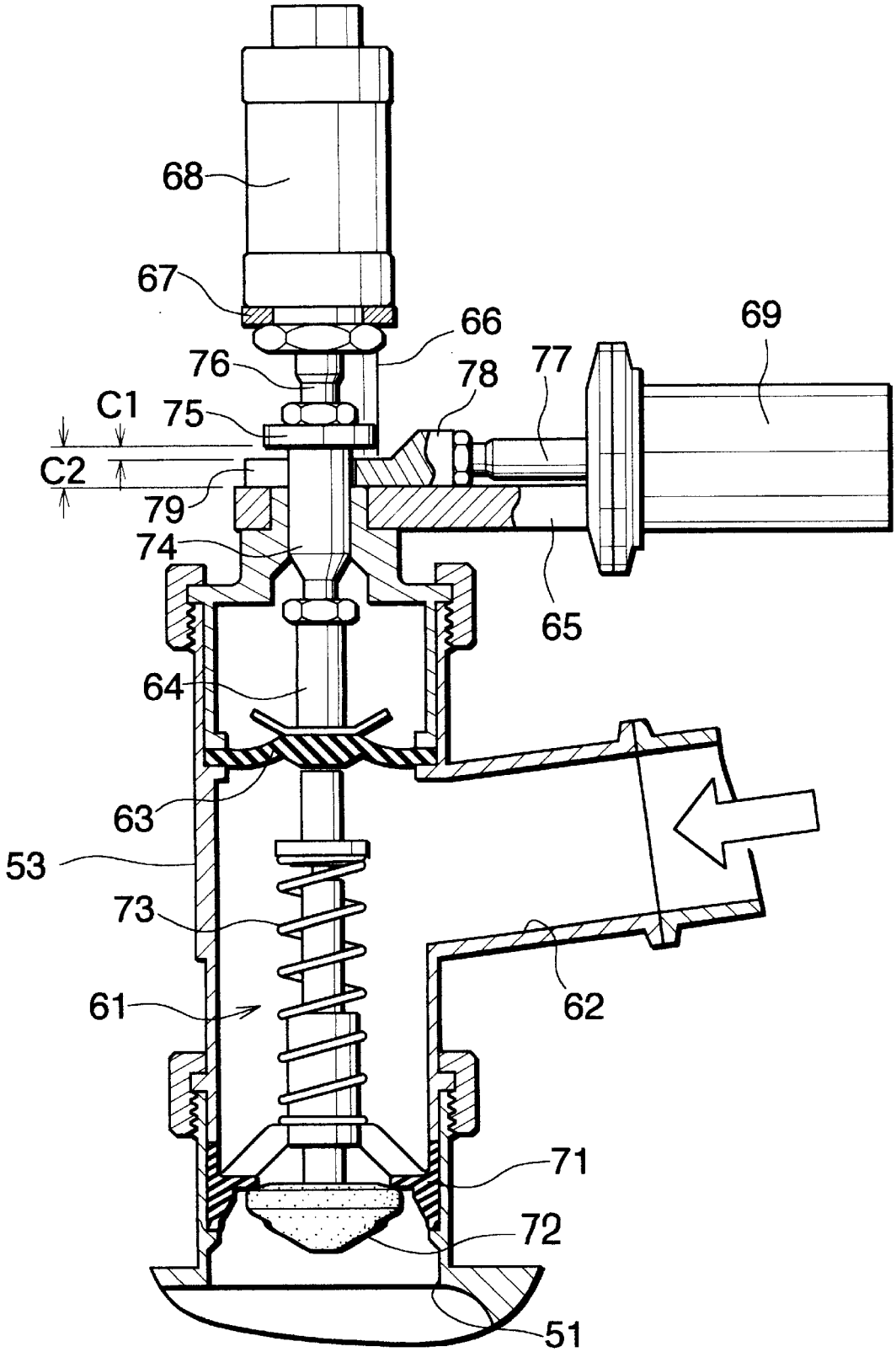
FIG. 2 is an enlarged fragmentary view in section of FIG. 1.
Figure 3:
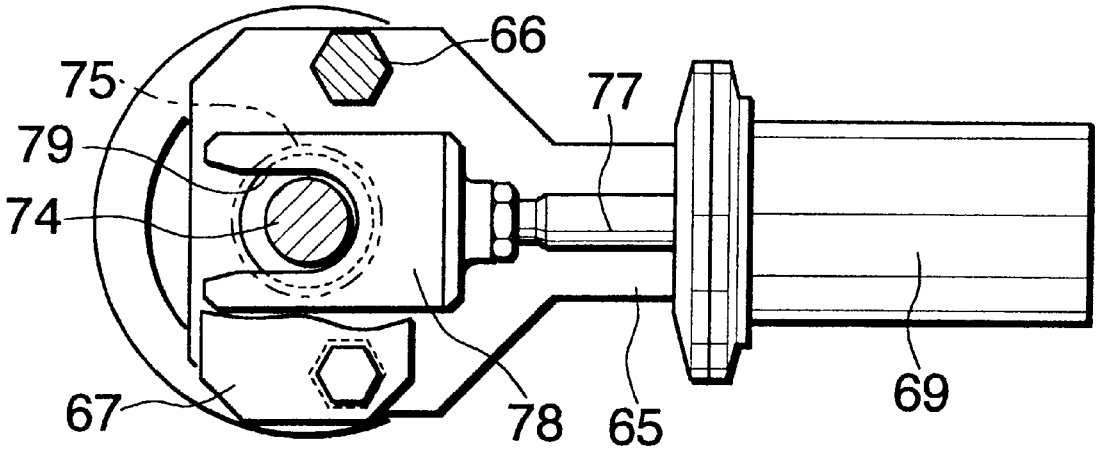
FIG. 3 is a plan view of the portion shown in FIG. 2.

As shown in detail in FIG. 2, an upper check valve 61 is provided in the inside lower part of the connecting tubular portion 53 for permitting the liquid to pass through the inlet 51 downward. The tubular portion 53 has a lateral communication opening 62 at the approximate midportion thereof. The interior of the tubular portion 53 is divided into an upper part and a lower part by an elastic membrane 63 extending transversely of the tubular portion 53 and positioned immediately above the opening 62. Connected to the central portion of upper side of the membrane 63 is the lower end of a vertical lift rod 64. A horizontal support plate 65 is fixed to the top of the connecting tubular portion 53 in a cantilever fashion. The support plate 65 is provided on its upper surface with a pair of vertical rodlike spacers 66 positioned closer to its fixed end. A second fluid pressure cylinder 68 directed vertically downward is attached to the upper ends of the spacers 66 by a horizontal mount plate 67. Attached to the free end of the support plate 65 is a third fluid pressure cylinder 69 directed horizontally laterally.

The upper check valve 61, which has the same construction as the lower check valve 23, comprises a seat ring 71 attached to the edge portion of the inlet 51, a poppet valve 72 positioned under and in intimate contact with the seat ring 71, and a spring 73 for biasing the valve 72 upward. The poppet valve 72 has an upper end face opposed to the central portion of lower side of the membrane 63 and spaced apart therefrom by a small clearance.

The lift rod 64 has a slide portion 74 in the form of a round bar and extending through the top of the connecting tubular portion 53 to project upward therefrom. The slide portion 74 is provided with a flange 75 at its upper end.

The second fluid pressure cylinder 68 has a piston rod 76 connected to the upper end of the slide portion 74. The second cylinder 68 has a piston stroke equal to that of the first cylinder 24.

The third fluid pressure cylinder 69 has a piston rod 77 projecting toward the lift rod 64. An engaging member 78 is connected to the outer end of the piston rod 77. The engaging member 78 slidably rests on the upper surface of the support plate 65 and has an engaging recessed portion 79, which is open toward a direction opposite to the rod-connected end of the member 78. The width of the opening is slightly larger than the outside diameter of the slide portion 74 but smaller than the outside diameter of the flange 75.

FIG. 2 shows the piston rod 76 of the second cylinder 68 as retracted, and the piston rod 77 of the third cylinder 69 as advanced, with the recessed portion 79 of the engaging member 78 fitting to the slide portion 74. In this state, a small clearance Cl is created between the flange 75 and the engaging member 78. When the piston rod 76 of the second cylinder 68 is advanced, the flange 75 comes into contact with the engaging member 78, whereby the piston rod 76 is halted. Accordingly, the stroke of the piston rod 76 of the second cylinder 68 is equal to the small clearance Cl. This stroke will be referred to as the "small stroke distance." The small stroke distance is, for example, about 1 to about 2 mm.

When the piston rod 77 of the third cylinder 69 is retracted from the position shown in FIG. 2, the recessed portion 79 of the engaging member 78 is moved out of fitting engagement with the slide portion 74, creating a large clearance C2 between the support plate 65 and the flange 75. This clearance is a large stroke distance of the piston rod 76 of the second cylinder 68. The large stroke distance is, for example, about 8 mm.

The inlet 32 of the filling nozzle 12 is held in communication with the outlet 52 of the metering cylinder 13 by a lower connecting pipe 81. The liquid tank 14 is held in communication with the opening 62 of the connecting tubular portion 53 by an upper connecting pipe 82. This arrangement provides a continuous liquid channel extending from the liquid tank 14 to the outlet 31 of the filling nozzle 12 through the metering cylinder 13.

The filling apparatus is further provided with a cleaning device (not shown in its entirety) for cleaning the interior of the apparatus when a filling operation is to be started or for a change of the liquid to be filled. The device has an adaptor 83 removably attachable to the outlet 31 of the filling nozzle 12.

For the filling operation, the piston rod 76 of the second cylinder 68 is moved the small stroke distance, whereby the poppet valve 72 is moved upward and downward a stroke distance approximately equal to the small stroke distance to open and close the upper check valve 61.

When the piston 42 is moved leftward in FIG. 1 with the upper check valve 61 left open, the liquid to be filled flows out of the tank 14 into the metering cylinder 13 through the inlet 51. The upper check valve 61 is then closed, and the piston 42 is moved rightward, whereby the liquid within the metering cylinder 13 is sent into the filling nozzle 12 through the outlet 52 while being prevented from flowing upward by the valve 61. The liquid sent in forces the lower check valve 23 open to flow down the nozzle body 21 and is discharged from the outlet 31 through the net 22.

Figure 4:
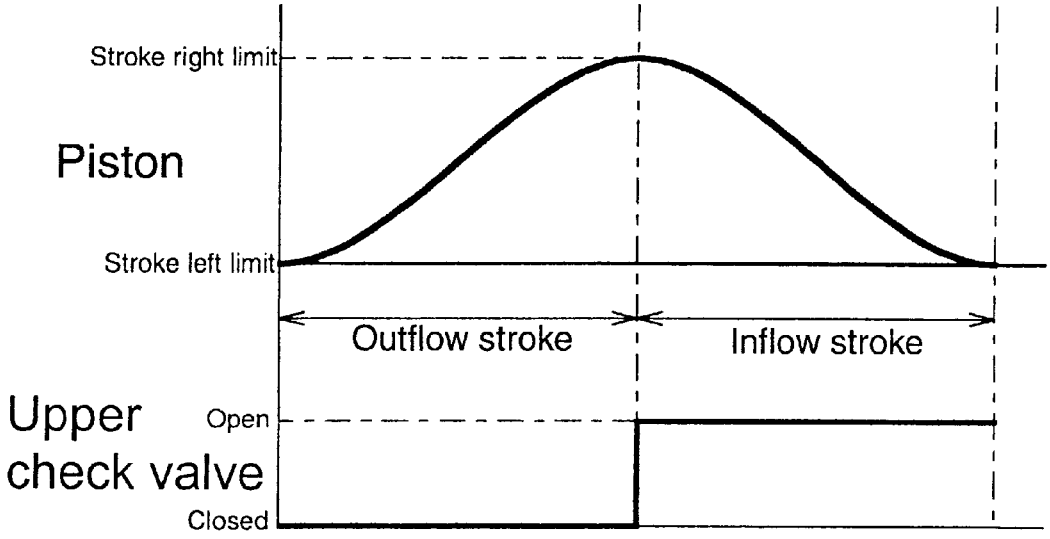
FIG. 4 is a stroke diagram showing piston strokes of a metering cylinder and a check valve operation as timed with the strokes.

FIG. 4 shows the timing of the piston strokes and the opening-closing timing of the upper check valve. The piston 42 and the second fluid pressure cylinder 68 are operated as thus timed with each other.

For cleaning, the piston rod 76 of the second cylinder 68 is moved the large stroke distance. In this case, the lower check valve 23 is also left open mechanically by the operation of the first fluid pressure cylinder 24.

In place of the liquid to be filled, a cleaning liquid is supplied to the liquid tank 14. The cleaning liquid supplied to the filling apparatus is collected through the adaptor 81 after passing through the apparatus.

It is likely that air will be held trapped in the filling liquid channel, for example, before the start of filling operation. It is desirable to remove such air from the channel. The air can be smoothly discharged by moving the piston rod 76 of the second cylinder 68 the large stroke distance also in this case.

The piston rod 76 of the second cylinder 68 (valve opening-closing means) and the upper check valve 61 described are provided separately, and the movement of the cylinder piston rod 76 (valve opening-closing means) is used only when opening the upper check valve 61, thereby allowing the upper check valve 61 to open and close basically following the movement of the piston 42 of the metering cylinder 41, whereby errors in the operation of the cylinder piston rod 76 (valve opening-closing means) can be prevented from leading directly to errors in the amount of liquid to be filled.

Furthermore, the provision of the piston rod 76 (valve opening-closing means) and the upper check valve 61 which are separate makes it possible to divide the interior of the connecting tubular portion 53 into the upper and lower parts by the membrane 63, rendering the filling liquid channel more sanitary. Although the cylinder piston rod 76 (valve opening-closing means) and the upper check valve 61 can be provided alternatively as connected together, it is then necessary to more accurately control the operation timing of the cylinder piston rod 76 (valve opening-closing means) and the stroke distance thereof since even a slight error in the operation of the cylinder piston rod 76 (valve opening-closing means) directly results in an error in the amount of liquid to be filled.

A servomotor is usable as the valve opening-closing means in place of the fluid pressure cylinder 68. The use of the motor improves the accuracy and speed of operation.

The present invention is applicable not only to the liquid filling apparatus described above but also to other liquid filling apparatus insofar as the apparatus comprise an apparatus body having a liquid channel connected at one end thereof to a liquid tank and at the other end thereof to a filling nozzle, a metering cylinder provided in the channel between opposite ends thereof in communication with the ends for causing the liquid to be filled to flow into and out of the liquid channel by strokes of a piston housed in the cylinder, and a check valve disposed upstream from the metering cylinder of the liquid channel.

What is claimed is:

1. A liquid filing apparatus comprising an apparatus body having a liquid channel connected at one end thereof to a liquid tank and at the other end thereof to a filling nozzle, a metering cylinder provided in the liquid channel between opposite ends thereof in communication with the ends for causing the liquid to be filled to flow into and out of the liquid channel by strokes of a piston housed in the cylinder, and a check valve disposed upstream from the metering cylinder of the liquid channel, the liquid filling apparatus being characterized in that the apparatus comprises valve opening-closing means for mechanically operating the check valve so as to open the valve during the inflow stroke of the piston and close the valve during the outflow stroke of the piston every cycle, wherein every cycle consists of one inflow stroke and one outflow stroke of the piston.

2. A liquid filling apparatus according to claim 1, further comprising means for setting the check valve to be open to one of a large and a small opening.

3. A liquid filling apparatus according to claim 2 wherein a valve seat facing downstream with respect to the direction of flow of the liquid is provided on a peripheral wall defining the liquid channel at a portion thereof upstream from the metering cylinder, the check valve comprising a valve disk movable toward and away from the valve seat on the downstream side thereof with respect to the flow direction, and a spring for biasing the valve disk toward the valve seat, the valve opening-closing means comprising a fluid pressure cylinder having a piston rod and so disposed as to move the valve disk away from the valve seat by an advancing stroke of the piston rod, the setting means comprising a movable engaging member engageable with and disengageable from the piston rod, and an actuator for moving the engaging member so that the disengagement of the member from the piston rod and the engagement of the member with the piston rod correspond respectively to the large and small degrees of opening of the check valve.

4. A liquid filling apparatus according to claim 3 wherein the engaging member is so disposed as to be movable straight across the path of movement of the piston rod, and the actuator is a fluid pressure cylinder having a piston rod connected to the engaging member.

5. A method of using a liquid filling apparatus according to any one of claims 2 to 4 wherein the interior of the liquid channel is cleaned or deaerated with the check valve set at the large degree of opening, and the apparatus is operated for filling with the check valve set at the small degree of opening.

* * * * *